US006203070B1

(12) United States Patent
Richardson

(10) Patent No.: US 6,203,070 B1
(45) **Date of Patent: *Mar. 20, 2001**

(54) CARD INCLUDING INSTRUCTIONS FOR MAKING A PRODUCT AND METHOD OF MAKING SUCH CARD

(75) Inventor: Javana Marie Richardson, Littleton, CO (US)

(73) Assignee: StarsEnd Creations, Inc., Greenwood Village, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/566,867

(22) Filed: May 8, 2000

Related U.S. Application Data

(63) Continuation-in-part of application No. 09/443,962, filed on Nov. 19, 1999.

(51) Int. Cl.[7] ..... B42D 15/00
(52) U.S. Cl. ..... 283/117; 40/124.1
(58) Field of Search ..... 283/117, 61, 62, 283/56; 40/124.1; 281/2, 5

(56) References Cited

U.S. PATENT DOCUMENTS

| | | | |
|---|---|---|---|
| Re. 33,680 | | 9/1991 | Drabish . |
| D. 347,242 | | 5/1994 | Yarnmunilert . |
| 4,070,778 | | 1/1978 | Mahler et al. . |
| 4,892,246 | | 1/1990 | Norman . |
| 4,907,826 | | 3/1990 | Versage . |
| 5,100,179 | | 3/1992 | Burden et al. . |
| 5,219,184 | | 6/1993 | Wolf . |
| 5,437,478 | | 8/1995 | Gaines . |
| 5,884,770 | | 3/1999 | Galm . |
| 5,946,834 | | 9/1999 | Bradley . |
| 6,024,386 | * | 2/2000 | Spector ..... 283/117 |

* cited by examiner

*Primary Examiner*—Willmon Fridie, Jr.

(57) ABSTRACT

A card such as a greeting card or post card to which both artwork and instructions for creating a product, such as a food recipe, may be applied. The card includes a weakened, frangible portion forming at least one sever line, along which the card may be severed into two segments. One of the segments contains the instructions and may be placed in a file box or other receptacle for future reference. A method for applying the artwork and instructions to the card is also disclosed.

8 Claims, 8 Drawing Sheets

CARD INCLUDING INSTRUCTIONS FOR MAKING A PRODUCT AND METHOD OF MAKING SUCH CARD

The instant application is a continuation-in-part application related to application Ser. No. 09/443,962, filed Nov. 19, 1999 for "CARD INCLUDING INSTRUCTIONS FOR MAKING A PRODUCT AND METHOD OF MAKING SUCH CARD". The subject matter of such application is incorporated herein by reference.

BACKGROUND OF THE INVENTION

The present invention generally relates to cards, such as greeting cards and postcards, that include instructions for creating a product, such as a recipe for making food. The invention also relates to a method of making such a card.

Greeting cards and post cards have conventionally included artwork and textual messages such as poetic expressions, humor, concern for one's well being, quotes from famous persons, and information about points or persons of interest.

It is known that such cards may include serrated lines along which the card may be torn and that the detached portion of the card may include receipts and personal checks and other negotiable instruments or may include return thank you cards. It is also known that such cards may include a series of serrated or perforated lines along which the card may be torn such that the detached portion contains the signature of a person sending the card, and such that the card may be reused and signed in another location by another person. Also, it is known that greeting cards may include tabs or pockets to hold business cards, photographs, and recipe cards.

It is further known that recipe books may be created by obtaining photographs and other artwork pertaining to commercial enterprises, sometimes with photographs and artwork being provided by the commercial enterprise, and sometimes with recipes being provided by the commercial enterprise.

SUMMARY OF THE INVENTION

The present invention relates to a card such as a greeting card or post card to which both artwork and instructions for creating a product, such as a food recipe, may be applied. The card includes a weakened, frangible portion forming at least one sever line, along which the card may be severed into two segments. One of the segments contains the instructions and may be placed in a file box or other receptacle for future reference. A method for applying the artwork and instructions to the card is also disclosed.

BRIEF DESCRIPTION OF THE DRAWINGS

The present invention will be described with reference the accompanying drawings, wherein.

DETAILED DESCRIPTION OF THE PREFERRED EMBODIMENT

Figure 2:
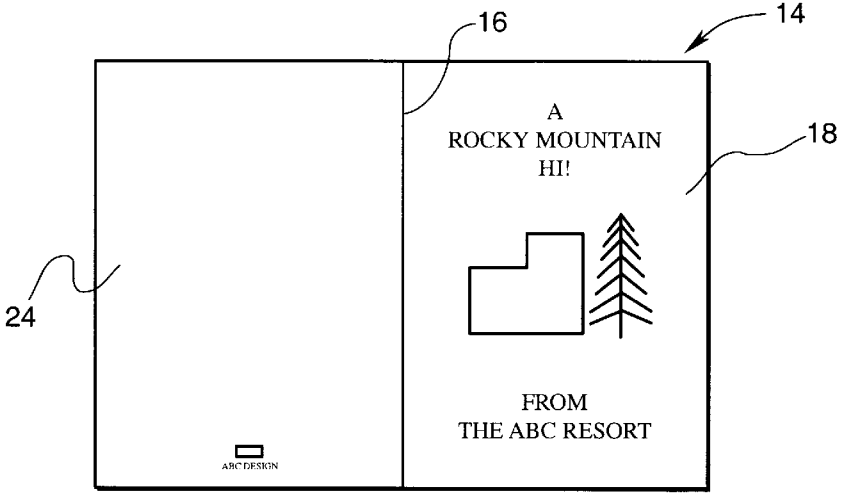
FIG. 2 is a plan view of the top surface of a single fold card that may be used in connection with the present invention.

The invention will be described with reference to the accompanying drawings wherein like reference numerals refer to the same item. It is to be clearly understood that this preferred embodiment is provided for descriptive purposes only and is not meant to unduly limit the scope of the inventive concept. Other embodiments are included within the inventive concept as set forth in the appended claims.

Figure 1:
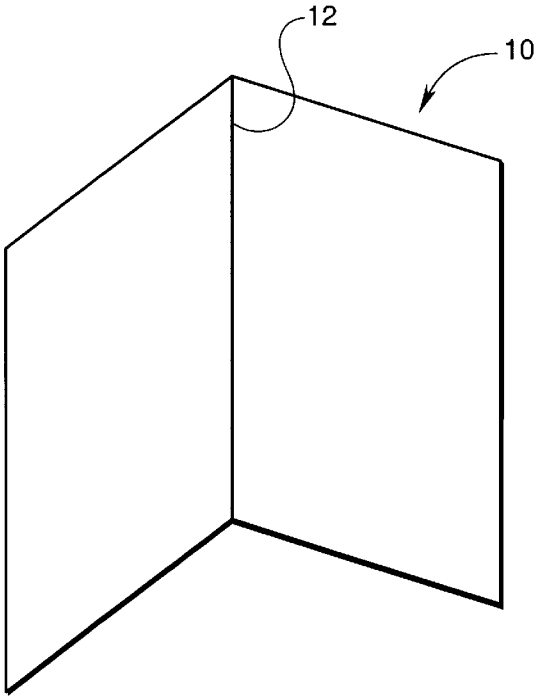
FIG. 1 is a perspective view of a single sheet, single fold card that may be used in connection with the present invention.

There is shown in FIG. 1 a single fold card 10 formed from a planar sheet of a material, such as paper, in a rectangular configuration. The card 10 is folded along a straight fold line 12 extending from one longitudinal edge to the other longitudinal edge of the card, midway between, and parallel to, the lateral edges.

It should be appreciated that the present invention may be utilized with cards having other configurations and with cards having more than one fold line and may also be utilized with cards having panels that are secured together in a book form by stitching, staples, glue, or other fastening mechanisms, instead of a single sheet formed into two panels by means of a fold line.

Figure 3:
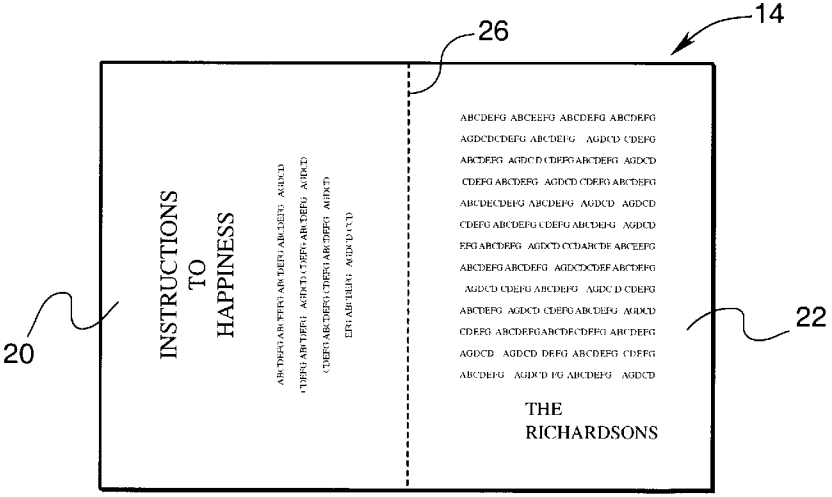
FIG. 3 is a plan view of the reverse surface of the single fold card shown in FIG. 2.

FIGS. 2 and 3 depict a greeting card 14 similar to the card shown in FIG. 1. The greeting card 14 includes a fold line 16, similar in all respects to the fold line 12 of the card shown in FIG. 1. As shown in FIG. 2, the card 14 includes a front cover panel 18, an inside cover panel 20, an inside rear panel 22, and a rear cover panel 24. The front cover panel 12 may include, for example, printed words comprising a greeting or salutation or other message, may include artwork, and may include the name of a business enterprise. The artwork may include, for example, photographs or paintings. The artwork may depict a scene such as a national monument, a famous person, animals, landscapes, etc. The artwork also may depict a scene associated with a commercial enterprise, such as a ski area, a hotel, a restaurant dining room, a horse barn, etc. The artwork may also be abstract or may depict humorous situations. Other types of artwork useful in connection with the present invention will be readily apparent to those skilled in the art of designing greeting cards. The inside cover panel 20 includes printed instructions for creating a product that is preferably intended to be implemented by the recipient of the card 14. The instructions preferably constitute a food recipe, but may also include how to cut and sew clothing patterns, how to make a wreath or other festive article, how to spread mulch into a garden, how to build a trellis, or how to make a handicraft. The inside rear panel 22 may be blank for the card sender to write a personal message or may contain poetry, words of concern, or information relative to either the material depicted on the front cover panel 18 or to the whereabouts of the sender. The rear cover panel 24 typically is substantially blank, with a bar code, copyright notice, and information respecting the card manufacturer or distributor.

The card 14 as shown in FIGS. 2 and 3 also includes a weakened or frangible portion defined by a scored line or a series of serrations or perforations forming a line 26. In the embodiment shown in FIGS. 2 and 3 the line 26 is coextensive with the fold line 16, but as will be appreciated from a further description of the invention, line 26 need not be coextensive with the fold line 16. Although the serrations or perforations may extend completely through the card 14, preferably the serrations or perforations extend into the card from only one surface, and also preferably do not extend into a surface bearing artwork.

A recipient of the card 14 may tear or sever the card 14 along the sever line 26 such that card 14 is detached into two segments and preferably so that one of the segments substantially bears the entire instructions for making a product. Also preferably the segment bearing the instructions will also bear at least a substantial portion of the artwork. By severing the card 14, the recipient of the card 14 may place the detached segment bearing the instructions into a file box or other receptacle for further reference. For example, if the instructions constitute a food recipe, the card segment may be placed in a food recipe book or card file box. Although the detached segment may have any configuration, further preferably, the detached segment is fashioned in a relatively standard configuration (such as a rectangular three inch by five inch dimension) that conforms to the conventional sizes for similar types of cards or file boxes. Also, it is preferable that the detached segment bearing the instructions also bears the artwork, including any commercial enterprise name, so that later use of the detached segment will remind the user of the origins of the segment and of the commercial enterprise. Preferably the artwork and information are applied to the card by conventional printing processes.

The artwork for a card may be provided by a commercial enterprise and used with its authorization, or the artwork may be obtained by the card manufacturer, preferably with the prior authorization of the commercial enterprise. Also, the instructions used conjointly with such artwork are preferably utilized with the authorization of the commercial enterprise, and may be even provided by the commercial enterprise. For example, the instructions might be a recipe for preparing the XYZ Dude Ranch's Yuletide egg nog and the artwork on the front cover panel 18 of the card 14 might include a picture of the Dude Ranch's horse barn with a horse drawn sleigh.

Figure 4:
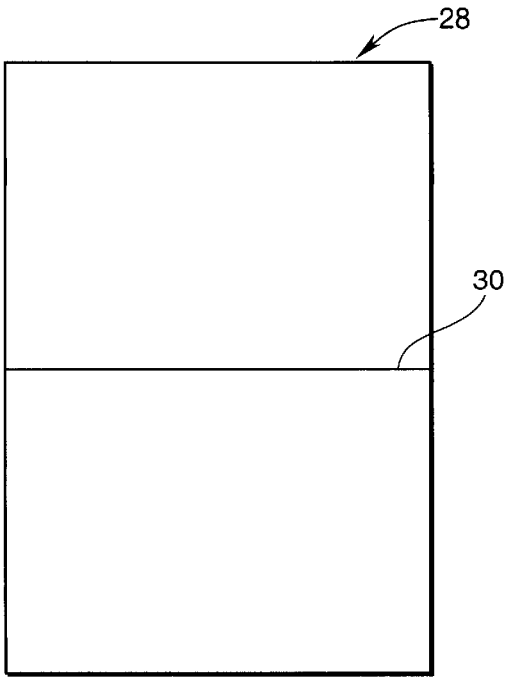
FIG. 4 is a plan view of one surface of a single fold card that may be used in the present invention.
Figure 5:
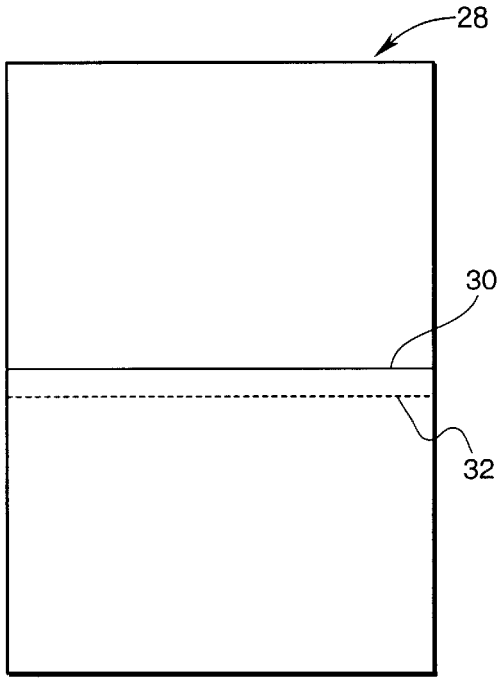
FIG. 5 is a plan view of the reverse surface of the single fold card shown in FIG. 4.

There is shown in FIGS. 4 and 5 a card 28 that is similar to the card 10 as shown in FIG. 1. The card 28 includes a fold line 30 similar in all respects to the fold line 12. The card 28 also includes a scored, serrated, or perforated line 32 that is spaced slightly from, and parallel to, the fold line 30.

Figure 6:
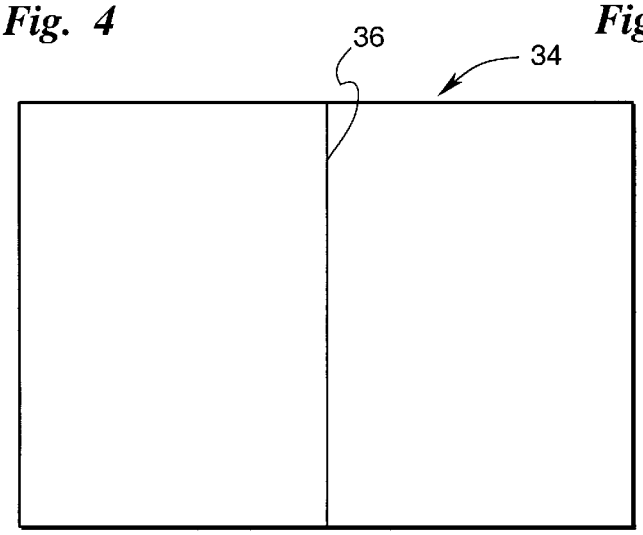
FIG. 6 is a plan view of one surface of a single fold card that may be used in connection with the present invention.
Figure 7:
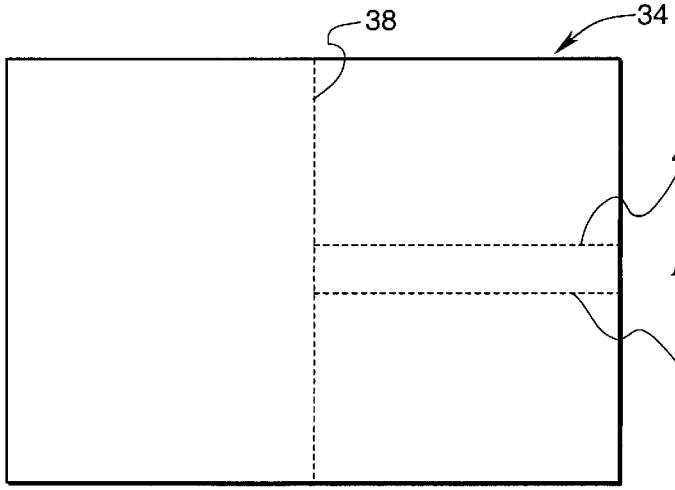
FIG. 7 is a plan view of the reverse surface of the card shown in FIG. 6.

There is shown in FIGS. 6 and 7 a card 34 that is similar to the card 10 as shown in FIG. 1. The card 34 possesses a fold line 36 in all respects similar to the fold line 12 of the card 10. As shown in FIG. 7, the card includes a scored, perforated, or serrated line 38 that is coextensive with the fold line 36. The card 34 also includes a pair of two other fold lines 40, 42, that are spaced slightly from each other and extend perpendicularly from the fold line 38 to a lateral edge of the card 34. By severing the card 34 along the fold lines 38,40,42, four segments will be created, including a relatively large rectangular segment, two identically configured, intermediate size rectangular segments, and a fourth, small, narrow rectangular segment. The two intermediate size rectangular segments may each bear instructions for making a product, such as a food recipe. The instructions may be identical, or they may relate to different products, such as a recipe for egg nog and a recipe for cinnamon rolls. If the instructions are identical, it is intended that the card recipient may pass the duplicate instruction along to a relative, friend, or acquaintance.

Figure 8:
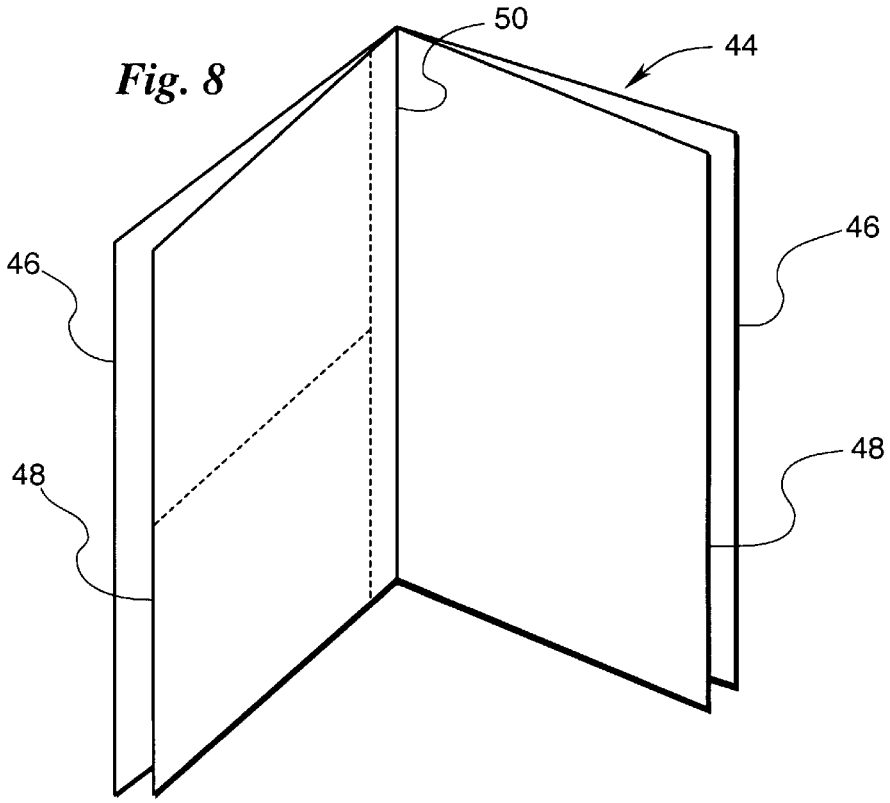
FIG. 8 is a perspective view of a two sheet single fold card that may be used in connection with the present invention.
Figure 9:
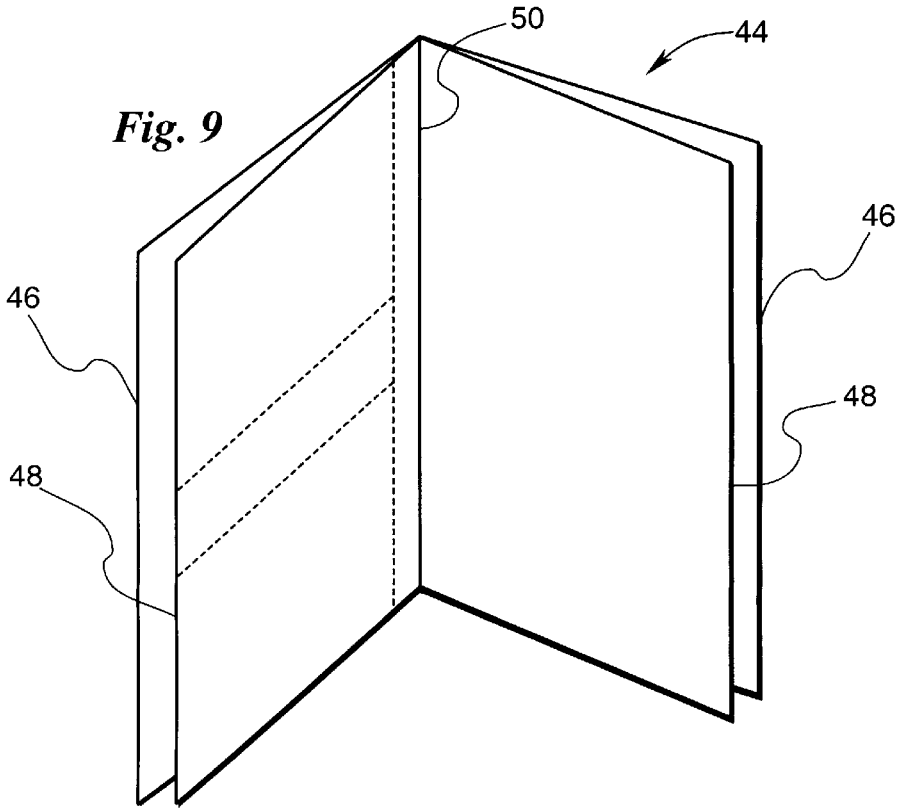
FIG. 9 is a perspective view of a modified version of the card shown in FIG. 8.
Figure 10:
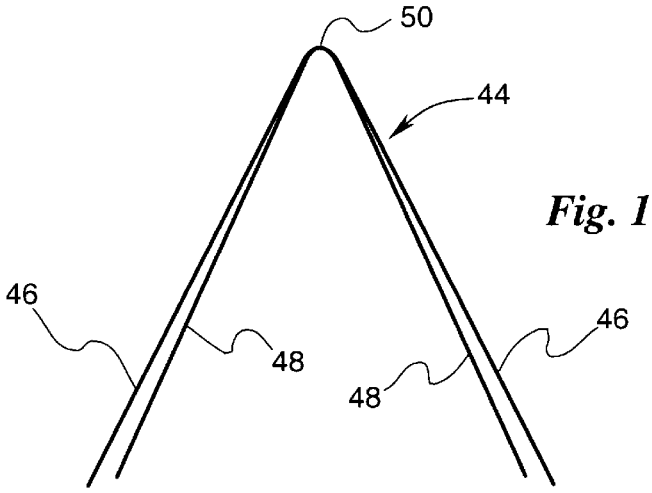
FIG. 10 is a top view of the card shown in FIGS. 8 and 9.

FIGS. 8–10 show another type of card 44 that may be used in connection with the present invention. The card comprises two sheets, 46, 48, of material, such as paper that have substantially similar configurations, that are placed in a substantially "planar", overlapping relationship and are folded along a common fold line 50. It should be appreciated that sever lines such as those previously described may be placed on either or both of the sheets 46, 48.

Figure 11:
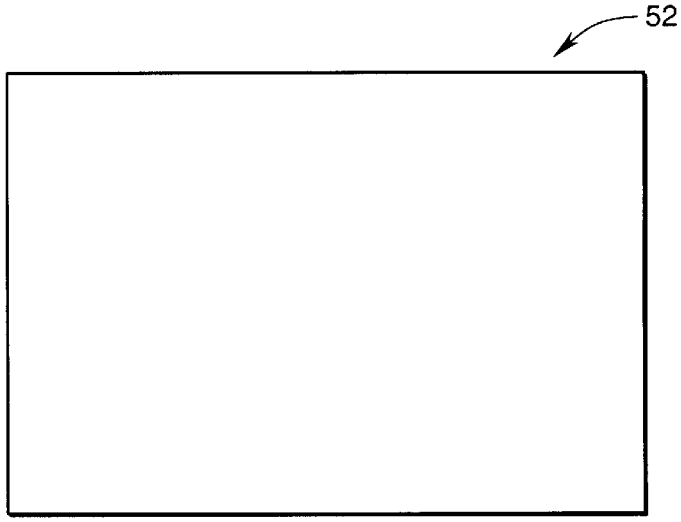
FIG. 11 is a plan view of one surface of a card that may be used in connection with the present invention.
Figure 12:
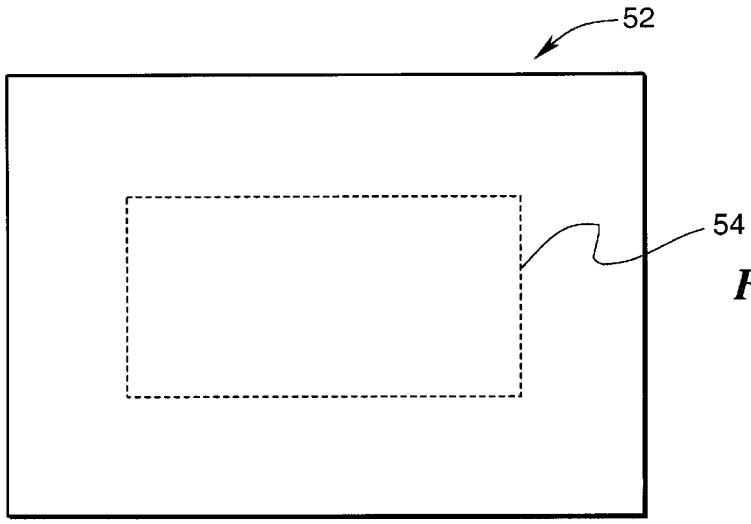
FIG. 12 is a plan view of the reverse surface of the card shown in FIG. 11.

FIGS. 11 and 12 show a card 52 that may be used in connection with the present invention. The card 52 comprises a single sheet of material and is designed not to be folded, such as a post card. The front surface of the card 52, as shown in FIG. 11 preferably includes artwork, and the reverse side shown in FIG. 12 preferably includes printed instructions within the boundary of the rectangularly shaped sever lines 54. By tearing or severing along the sever lines 54, the card 52 will be severed into two segments, one of which bears the instructions on one surface, and the other surface preferably bearing artwork.

Figure 13:
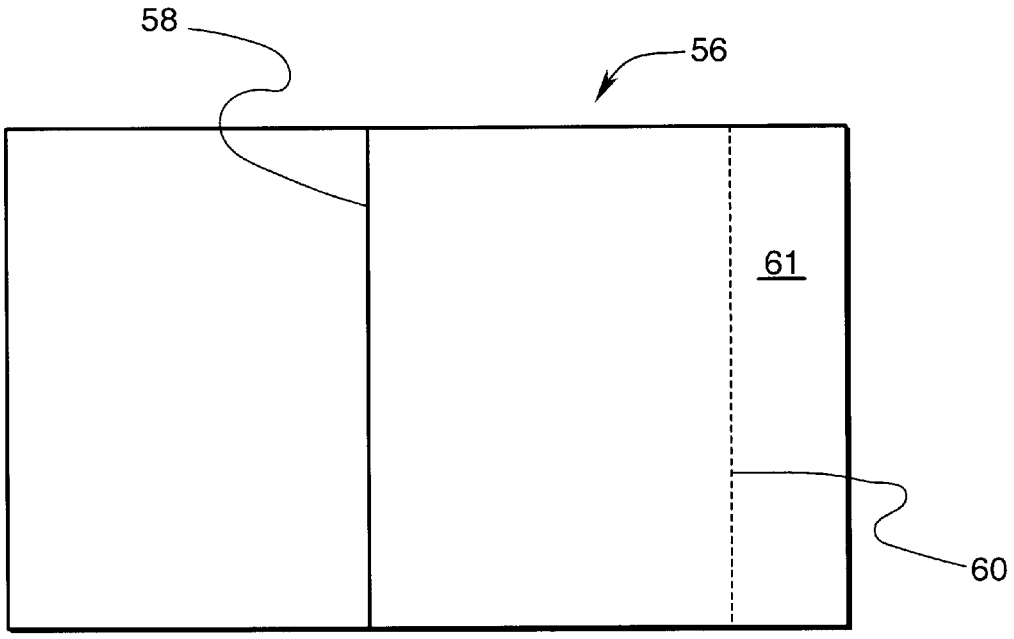
FIG. 13 is a plan view of one surface of a double fold card that may be used in connection with the present invention.
Figure 14:
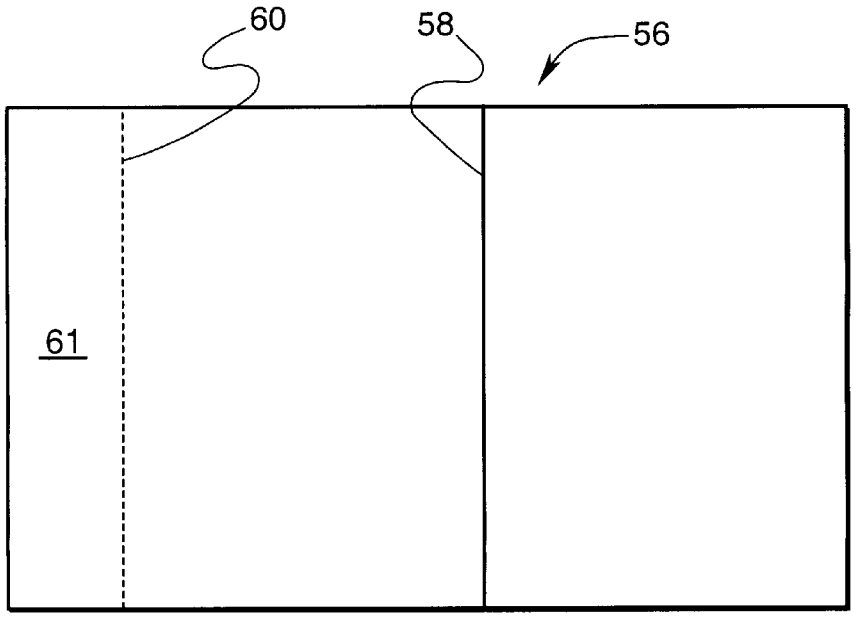
FIG. 14 is a plan view of the reverse surface of the card shown in FIG. 13.

FIGS. 13 and 14 show a card 56 that may be used in connection with the present invention. The card 56 comprises a single sheet of material possessing two spaced, parallel fold lines 58, 60 which divide the card into substantially equal rectangular segments. The fold line 60 is also scored, serrated, or perforated whereby a substantially rectangular shaped flap portion 61 may be severed from the remaining portion of the card 56. The flap portion 61 bears the printed instructions for making a product on one surface thereof, and may include artwork on the other surface thereof.

Figure 15:
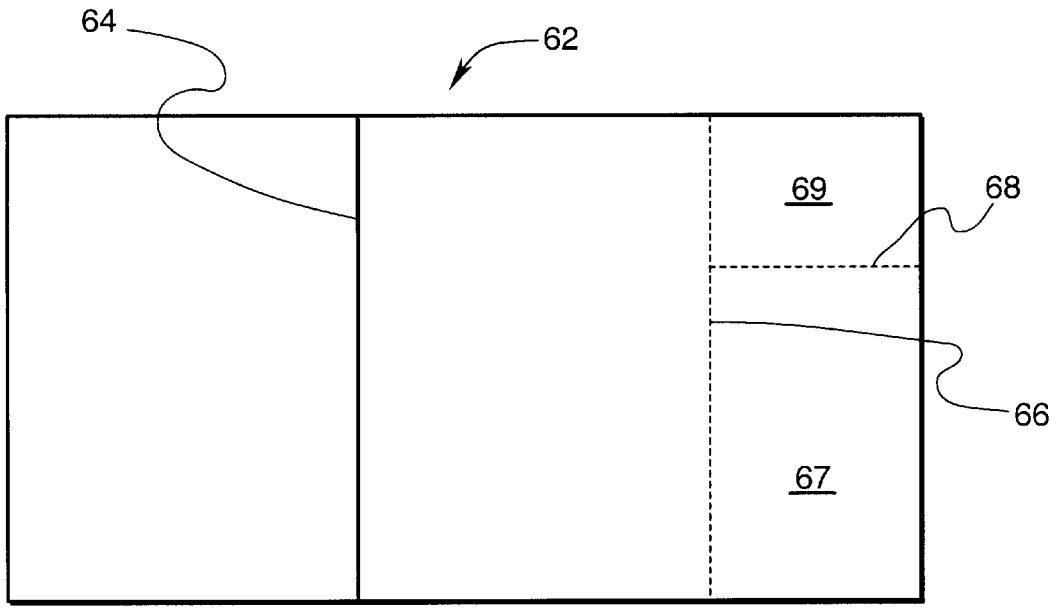
FIG. 15 is a plan view of one surface of another double fold card that may be used in connection with the present invention.
Figure 16:
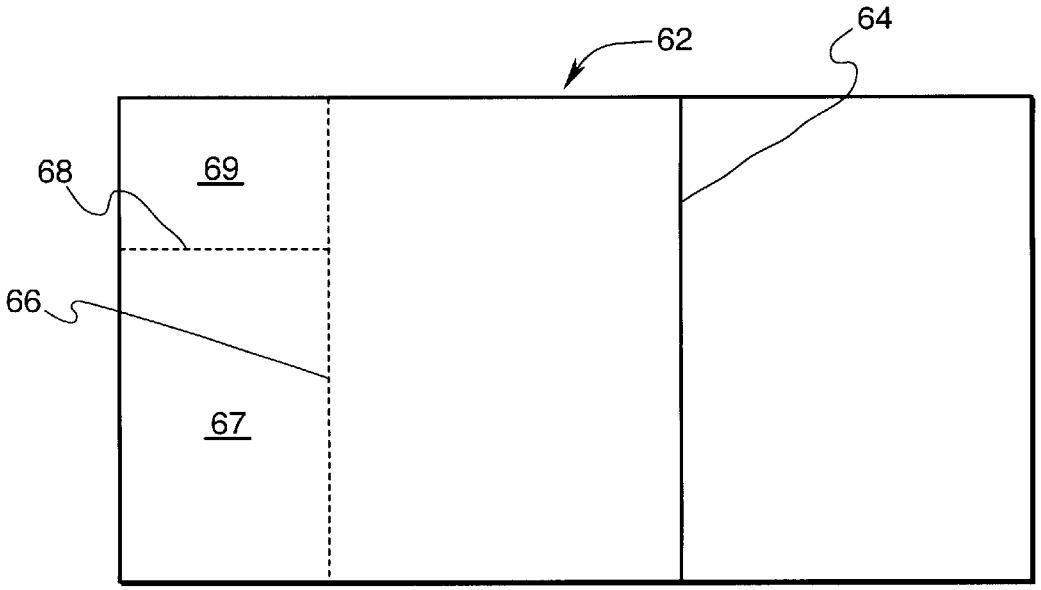
FIG. 16 is a plan view of the reverse surface of the card shown in FIG. 15.

There is shown in FIGS. 15 and 16 another card 62 that may be used in connection with the present invention. The card 62 comprises a single sheet of material and includes two spaced, parallel fold lines 64, 66 which divide the card 62 into two substantially equal rectangular segments. The fold line 66 is also scored, serrated, or perforated whereby a substantially rectangular shaped flap portion containing segments 67 and 69 may be separated from the remainder of the card 62. The card 62 also includes a scored, serrated, or perforated line 68 extending substantially perpendicular to the fold line 66 approximately two-thirds to three-quarters of the distance along the fold line 66. The score line 68 extends from the fold line 66 to the adjacent-most lateral edge of the card 62 and divides the flap portion into the two rectangularly shaped segments 67, 69. The segment 67 may bear printed instructions for making a product on one surface thereof, and artwork on the other side thereof. The segment 69 may include information such as that normally contained on a business card, such as person's name, the person's company name, the person's job title, the company address, and telecommunications contact information for the person or company. Alternately, the segment 69 may also bear printed instructions for making a product on one surface thereof and may include artwork on the other surface thereof, that is similar to or different from the printed instructions and artwork on the segment 67.

Figure 17:
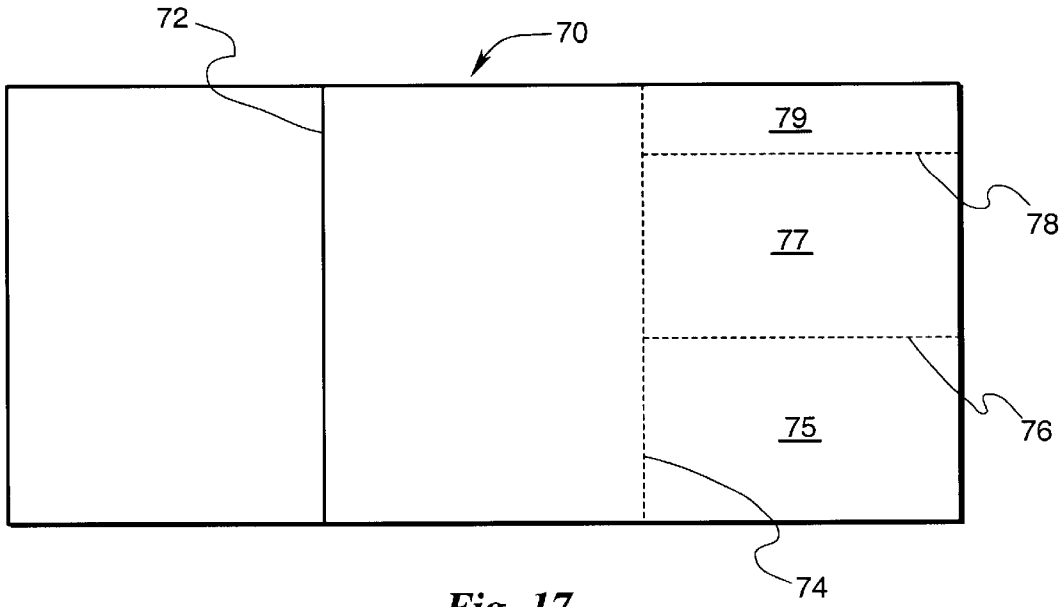
FIG. 17 is a plan view of one surface of yet another double fold card that may be used in connection with the present invention.
Figure 18:
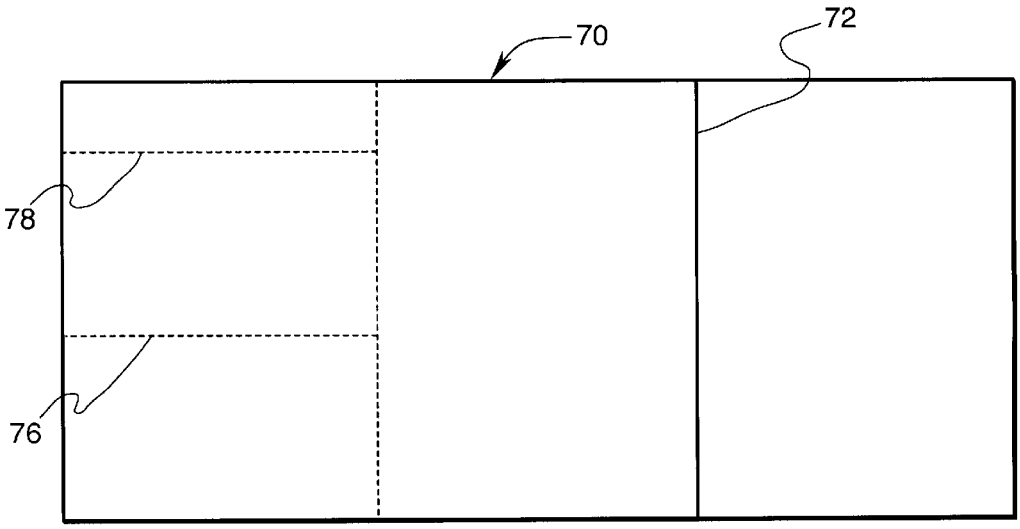
FIG. 18 is a plan view of the reverse surface of the card shown in FIG. 17.

FIGS. 17 and 18 show yet another card 70 that may be used in connection with the present invention. The card 70 comprises a single sheet of material possessing two spaced, parallel fold lines 72, 74 which divide the card into substantially equal rectangular segments. The fold line 74 is also scored, serrated, or perforated whereby a substantially rectangular shaped flap portion may be severed from the remaining portion of the card 70. The flap portion contains three rectangular segments 75, 77, 79 and printed instructions for making a product on one surface thereof, and includes artwork on the other surface thereof.

Segment 75, 77, 79 may be separated from the remainder of the card 70 by tearing along perforated fold line 74. Spaced, parallel perforation lines 76, 78 extend from the fold line 74 to the adjacent-most lateral edge of the card 70. The first perforation line 76 extends at approximately two-fifths of the distance along the fold line 74, and the second perforation line 78 extends from a point approximately four-fifths of the distance along the fold line 74. The segments 75, 77 are approximately of equal, rectangular size, and segment 79 is of a rectangular size having approximately one-half the height and the same width as the other rectangular shaped segments 75, 77. Each of the segments 75, 77, 79 may bear the same or different printed instructions for making a product, and the other side of each segment 75, 77, 79 may bear the same or different artwork. Alternately, the segment 79 may bear little or no information, and may be discarded as scrap. Also alternatively, one of the segments 75, 77, may bear information such as that normally contained on a business card, as described above.

Figure 19:
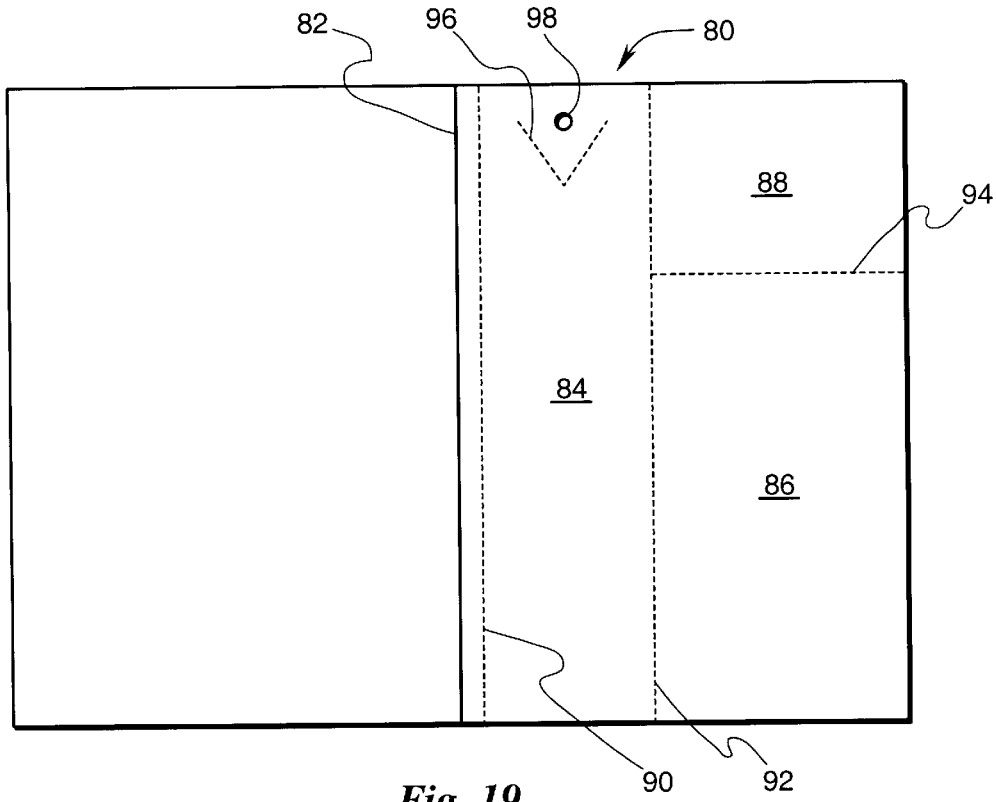
FIG. 19 is a plan view of one surface of another single fold card that may be used in connection with the present invention.
Figure 20:
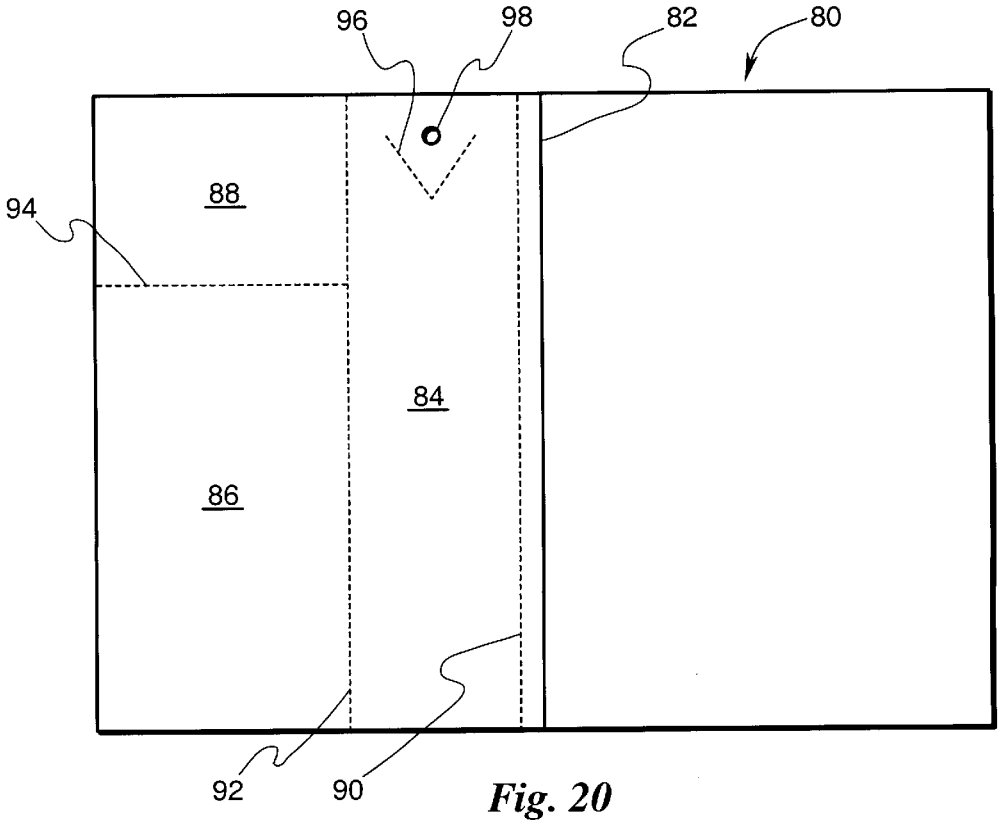
FIG. 20 is a plan view of the reverse surface of the card shown in FIG. 19.

FIGS. 19 and 20 show another single fold card 80 that may be used in connection with the present invention. The card 80 comprises a single sheet of material possessing a central fold line 82 that laterally bisects the card 80 into substantially equal rectangular segments. One of the rectangular shaped segments further contains three rectangular segments 84, 86, 88. The three segments 84, 86, 88 may be separated from the remainder of the card 80 by tearing along a perforated sever line 90 that may be scored, serrated, or perforated. The sever line 90 is spaced slightly from and is parallel to the fold line 82. The three rectangular segments 84, 86, 88 may be further separated from each other by tearing along two sever lines 92, 94 that may each be scored, severed, or perforated. The first sever line 92 is spaced from and parallel to the sever line 90, and the second sever line 94 extends perpendicular to the sever line 92 toward the adjacent-most lateral edge of the card 80. The second sever line 94 extends approximately two-thirds of the distance along the sever line 92 and along the lateral edge of the card 80.

Preferably the segment 84 includes a "v"- shaped sever line 96 that may scored, serrated or perforated and that is located near one longitudinal end thereof. Also, a hole 98 may extend through the segment 84 adjacent to the v-shaped sever line 96 and slightly closer to the longitudinal end of the segment 84. Both the v-shaped sever line 96 and the hole 98 are centrally disposed midway between the parallel lateral edges of the segment 84. It will be appreciated that the segment 84 may be utilized as a book mark. The hole 98 is adapted so as to receive colored string or a tassel (not shown) as is often utilized with bookmarks. Also, the v-shaped sever line 96 may form a flap or tongue that is used to hook one or more pages of the book so as to selectively hold the bookmark at a selected location in the book. The segment 84 may bear printed information conveying to the reader that the segment 84 is to be used as a bookmark (such as the word "bookmark"), and may include artwork.

The segment 86 preferably possesses a three inch by five inch dimension and preferably includes on one surface thereof printed instructions for making a product, such as a recipe, and preferably the other surface thereof bears artwork.

Lastly, the segment 88 may bear information such as that normally contained on a business card, as described above.

The invention has been described with reference to greeting cards and post cards. As used herein, the term "greeting cards" conventionally encompasses birthday cards, anniversary cards, mother's day and father's day cards, thank you cards, get well cards, wish-you-were-here-cards, hello cards, bereavement cards, thinking-of-you cards, Valentine's Day cards, friendship cards, holiday cards, and other cards typically found in "greeting card" sections of supermarkets and other retail stores. The term "post cards" refers to a single sheet, unfolded, planar card usually delivered by mail and usually relating to a hotel, a resort, a historical point of interest, or to a geographic location.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed.

Although particular embodiments of the present invention have been described and illustrated herein, it should be recognized that modifications and variations may readily occur to those skilled in the art and that such modifications and variations may be made without departing from the spirit and scope of my invention. Consequently, my invention as claimed below may be practiced otherwise than as specifically described above.

What is claimed is:

1. A greeting card comprising:

(a) a sheet of material, said sheet possessing at least two spaced, substantially parallel fold lines extending substantially entirely thereacross from one edge to another edge whereby the sheet may be folded into a first panel, a second panel, and a third panel, said first panel bearing artwork, said sheet bearing instructions for creating a product, said instructions adapted to be followed by a recipient of said greeting card, said sheet further possessing a substantially weakened, frangible portion defined substantially by at least one sever line, whereby said sheet is adapted to be severed along said weakened portion into a first segment and a detached second segment, and said weakened portion being located such that when said sheet is so severed, said second detached segment bears substantially entirely said instructions and said detached second segment is adapted to be retained by the recipient at a location separate from the location of said first segment.

2. A greeting card according to claim 1 wherein said at least one sever line is substantially formed of a series of serrations or perforations.

3. A greeting card according to claim 1 wherein said at least one sever line is substantially coextensive with one of said fold lines.

4. A greeting card according to claim 3 wherein said at least one sever line is substantially formed of a series of serrations or perforations.

5. A greeting card according to claim 1 wherein there are at least two sever lines, a first one of which is substantially coextensive with one of said fold lines, and a second sever line which is substantially perpendicular to said first sever line.

6. A greeting card according to claim 5 wherein each of said two sever lines is substantially formed of a series of serrations or perforations.

7. A greeting card according to claim 1 wherein said detached second segment is substantially rectangular.

8. A greeting card according to claim 1 wherein said first segment may also be detached and wherein said detached first segment bears at least three categories of information selected from the group of categories consisting of: a company name, a company address, telecommunications contact with a company, a person's name, and a person's job title.

* * * * *